United States Patent [19]

Anderson

[11] Patent Number: 4,595,173

[45] Date of Patent: Jun. 17, 1986

[54] CAPSTAN WINCH, PARTICULARLY FOR SAILING BOATS

[76] Inventor: Frode Anderson, Olaf Ryesvej 4, 7100 Vejle, Denmark

[21] Appl. No.: 645,326

[22] PCT Filed: Dec. 22, 1983

[86] PCT No.: PCT/DK83/00127

§ 371 Date: Aug. 23, 1984

§ 102(e) Date: Aug. 23, 1984

[87] PCT Pub. No.: WO84/02511

PCT Pub. Date: Jul. 5, 1984

[30] Foreign Application Priority Data

Dec. 27, 1982 [DK] Denmark ..... 5736/82

[51] Int. Cl.[4] ..... B66D 1/14; B66D 1/30

[52] U.S. Cl. ..... 254/342; 254/354; 254/371

[58] Field of Search ..... 254/342, 352, 353, 371

[56] References Cited

U.S. PATENT DOCUMENTS 1,177,767 4/1916 Eggleston ..... 254/342 X
2,408,365 10/1946 Biehl et al. ..... 254/342 X
3,985,340 10/1976 Guangorena ..... 254/344
4,143,855 3/1979 Burton et al. ..... 254/352 X
4,225,118 9/1980 Ottemann ..... 254/376 X

FOREIGN PATENT DOCUMENTS 1368739 10/1974 United Kingdom ..... 254/342

*Primary Examiner*—Stuart S. Levy
*Assistant Examiner*—Katherine Matecki
*Attorney, Agent, or Firm*—Antonelli, Terry & Wands

[57] ABSTRACT

A selftailing capstan winch having a stationary shaft element which holds bearings for a winch drum and houses a driving shaft adapted to be crank handle driven from above. The shaft element has a fixed radial arm projecting outwardly about a drum top flange and into an upper annular rope groove. The driving shaft is mounted eccentrically in the stationary shaft element. The driving engagement with the drum is established by a pinion on the rotary shaft which simply engages an interior, relative broader toothed rim on the drum. With this arrangement, the drum is not rotated as quickly as the crank handle; however, the driving arrangement is simple and robust.

5 Claims, 4 Drawing Figures

CAPSTAN WINCH, PARTICULARLY FOR SAILING BOATS

The present invention relates to a capstan winch, particularly for sailing boats, which comprises a stationary shaft element to be mounted projecting from a mounting surface such as a boat deck and a winch drum, which is mounted on the shaft element and is rotatable by means of an outer crank handle. In use the rope to be hauled in is wound a few turns about the winch drum, whereafter the operator can haul in the rope by rotating the drum, when the rope end as running off the drum is maintained taut. Thus, it is required to simultaneously turn the crank handle and maintained the off-running rope taut, which is a matter of inconveniently making use of both hands.

Therefore, so-called self tailing winches have been developed, in which one end of the drum, normally the outer end, is provided with a disc, which, together with the associated, widened end surface of the drum, confines an annular, narrow groove, which may receive and frictionally engage a single rope turn, with the groove preferably having a wedge shaped cross section and a bottom area of a diameter substantially equal to the diameter of the active cylindrical portion of the winch drum.

The rope end as running off from the drum is laid tightly into the annular groove, whereby the tightness of the rope will be maintained during the further rotation of the drum inasfar as the groove walls as holding the rope will rotate together with the drum. Hereby, however, the rope winding as held in the groove will tend to run back into itself, and, in practice, it is necessary, therefore, to arrange for a stationary member to be located in the groove for successively guiding the rope from the groove. Correspondingly, the rope may be present in the groove only along half or three quarters of its peripheral length, but the associated frictional engagement will be sufficient to achieve the desired tightening of the rope as running off the drum during the continued rotation thereof.

Constructionally the provision of such a stationary outlet member inside the groove of the rotary assembly is rather inconvenient. For obvious reasons the outlet member must be arranged so as to project into the groove from the outside, and since the winch drum should preferably be freely accessible all the way round it is natural to provide the outlet member on a radial arm as projecting outwardly from an outer end of the stationary shaft element. Thus, the stationary shaft element should project beyond the outer end of the rotary drum element with associated tightening groove. This involves that the rotary element cannot be rotated just by a simple axial engagement with a crank handle, because the handle should by necessity be engaged centrally, when a rotation about a stationary part having a fixed radial arm is to be produced. Thus, a driving connection is established between a central drive shaft as rotated by the crank handle and an interior area of the rotary drum element, through or across a stationary part surrounding the drive shaft and carrying the said outer radial arm.

This problem has given rise to many considerations as to a practical solution of the problem. It stands as a natural condition that the drum and the associated tightening groove should be rotated by the crank handle in the same direct synchronous manner as with the winches of the first mentioned simple type, and on this background some complicated solutions have been developed, such as, for example, in GB-A-2,034,661, wherein the winch drum is rotated by special pawl mechanisms, which are mounted on the inside of the drum so as to cooperate with one side of an exterior toothing on the crank driven shaft as arranged eccentrically with respect to the drum, with the pawl mechanisms being held inoperative adjacent the opposite side of said toothing, whereby at this place there is provided space for a stationary element to project through the driving engagement area for carrying at its outer end the fixed radial arm as holding the outlet member in the tightening groove. The problem is in fact hereby overcome, but the solution is expensive and connected with various other drawbacks.

The invention more specifically relates to a capstan winch primarily for sailing boats, and of the type which includes a stationary base and a shaft element adapted to be mounted so as to project from a mounting surface such as, for example, a boat deck, with a winch drum being mounted on the shaft element and an outer drive member such as, for example, a crank handle, cooperating with the rotatable shaft in a middle or center area of the winch. The rotatable shaft is disposed eccentrically relative to the winch drum and is provided with monolaterally active driving means engaging an interior area of the drum for rotating the drum. The stationary shaft element projects outwardly from the drum and the rotatable shaft through an area diametrically opposite to the engagement area of the driving means and further out to a free end of the drum, where the shaft element carries a fixed radial arm projecting outwardly and downwardly about an upper disc flange on the drum and into an annular rope holding groove adjacent the upper end of the drum. In such winch, an eccentric mounting and an associated monolateral driving function of the driving shaft provide for the possibility of arranging, inside the drum and adjacent or along the opposite side of the driving shaft, a stationary element, which may carry at its outer end the said radial arm and even carry bearing means for the outer ends of both the drum and the driving shaft.

It is the purpose of the invention to provide a constructionally simple capstan winch of this type, and the invention is based on the recognition that, in practice, despite the habitual desire of the rotations of the crank handle and the drum being synchronized, it is in no way decisive whether these rotations are fully synchronous. Every user will readily accept the winch drum, to be rotated somewhat slower than the crank handle, and according to the invention it is made possible hereby to permit the driving engagement between the eccentric driving shaft and the drum be realized simply by way of a pinion, which is rigidly and concentrically mounted on the driving shaft and which cooperates with a partial area of an internal, broader toothed rim on the drum. In this partial area will thus exist a permanent driving engagement as corresponding to generally known driving engagements between a driving pinion and a broader, internally toothed rim. What is important in connection with the invention is the associated relevant possibility of mounting, through the space diametrically opposed to the driving engagement area, a stationary element for carrying the fixed radial arm. Thus, the driving engagement may be a simple pinion drive without any special pawl lifting arrangements, and the winch according to the invention, therefore, may show not only a simplified design, but even an increased operational safety and a smooth operative rotation.

Preferably the pinion drive is arranged in the lower, expanded portion of the drum, whereby there is sufficient space for the toothed rim to have a relatively large diameter. By this arrangement the pinion on the eccentric shaft may be of a comparatively large diameter, such that the gear ratio will not substantially deviate from the full synchronism.

In the following the invention is described in more detail with reference to the drawing, in which.

Figure 1:
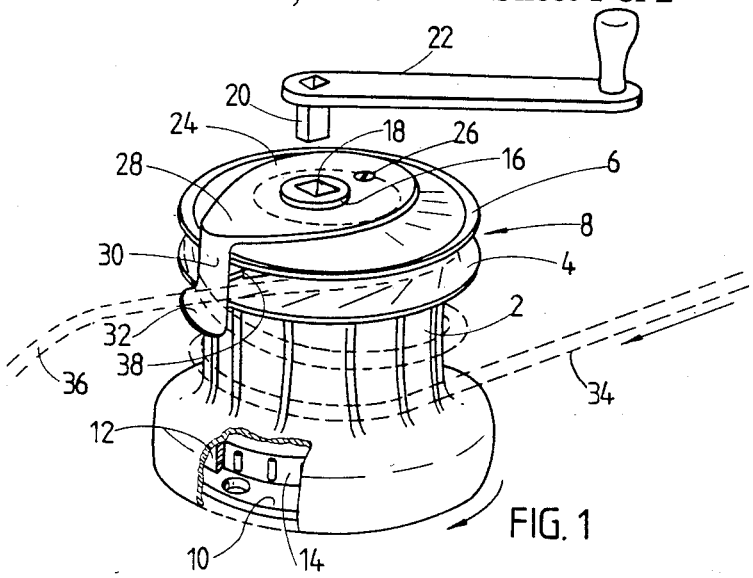
FIG. 1 is a perspective view of a winch according to the invention.

Referring now to the drawings wherein like reference numerals are used throughout the various views to designate like parts and, more particularly, to FIG. 1, according to this figure, a winch includes a winch drum 2 having an upper flange 4 and a co-rotating disc member 6 forming, together with the top side of the flange 4, an annular rope groove 8. The winch drum 2 is mounted on an internal core or base member having at its lower end an outstanding flange 10 provided with screw holes for its mounting on for example a boat deck. The drum has a lower cylindrical flange 12 as supported against a bearing ring 14 on the base member.

Topwise the winch shows the upper end of a drive shaft 16 having a central, polygonal hole 18 for receiving a driving block 20 of a crank handle 22. The shaft 16 projects through a hole in an upper plate 24, which, by a screw 26, is rigidly secured to an underlying, central top end of the base member. The plate 24 has a radially projecting arm portion 28, the outer end of which is provided with a portion 30 as depending past the flanges 6, 4 and at its lower end having an outstanding, inclined collar portion 32 outside the drum flange 4.

In operation of the winch a rope 34 to be hauled in is laid a few turns about the drum 2 and is then laid upwardly along the fixed collar portion 32 and into the upper rope groove 8, from which the rope is let out after almost a complete turn therein; the off-running end of the rope is designated 36. When the drum is rotated by the handle 22, the rope 8 will be hauled in even if the off-running rope 36 is not pulled taut, because the rope is successively held taut about the drum 2 by virtue of the sliding blocking as occurring in the groove 8. Just because of the frictional engagement between the rope and the groove 8 the rope shall have to be forced out of the groove, and this may be effected either by the rope being moved against the depending plate portion 30 or, preferably, by the rope running against a fixed outlet member 38, which is mounted on the plate portion 30 so as to project into the groove 8. Thus, the off-running rope 36 should not be kept tightened for making the winch operative, i.e. the winch can be operated by one hand, viz. just for rotating the drum 2.

Figure 2:
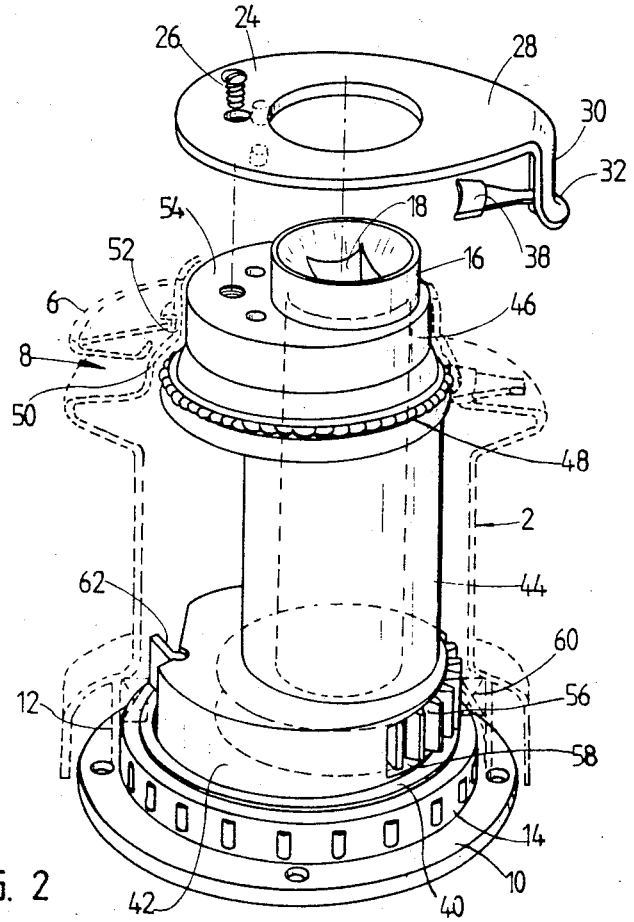
FIG. 2 is an exploded view of the internal parts of the winch.

As shown in FIG. 2, the rigid base member continues from the bottom flange 10 upwardly in a cylindrical portion 40, on which the bearing ring 14 is mounted, and, thereafter, in a housing portion 42 and further in a cylindrical portion 44, which is eccentric relative the housing portion 42 and is topwise provided with a head portion 46 as again concentric with the bottom parts. The head portion 46 has a ball ring bearing 48 for carrying and laterally supporting an upper portion 50 of the drum 2. The drum portion 50 continues upwardly in a narrowed cylindrical portion 52, which supports the surrounding upper disc member 6. The head portion 46 has an upper surface 54, to which the plate 24,28 is fixed by the screw 26.

The shaft 16 is put down centrally through the eccentric cylindrical portion 44, and down in the housing portion 42 the shaft is connected with a pinion 56 as inserted into a monolaterally open recess 58 in the housing portion 42, such that the pinion 56 at one side is projecting from the circumference of the housing portion 42. Opposite to this circumference portion the housing portion 42 is thick-walled, i.e. the fixed cylindrical portion 44 is rigidly associated with the cylindrical bottom portion 40 through the housing portion 42, and in practice the parts 10,40,42,44 and 46 are made as a one-piece casting.

Figure 3:
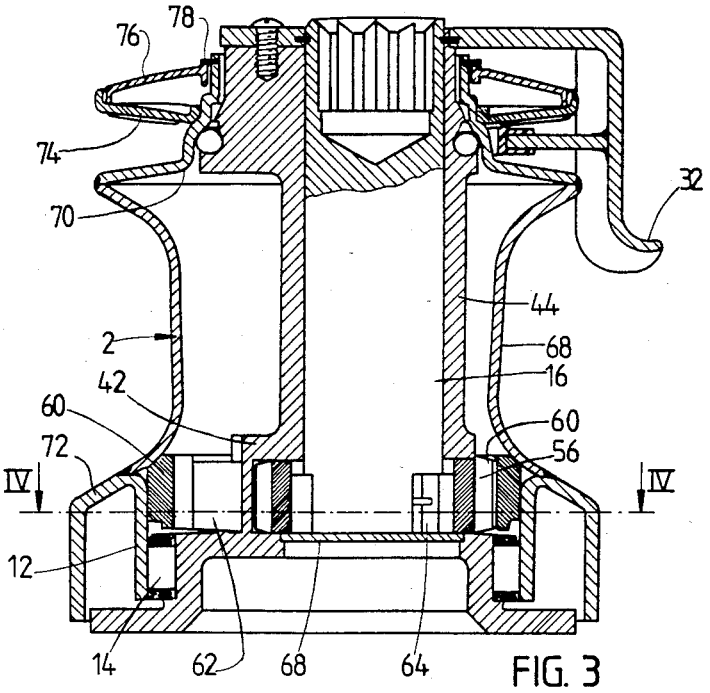
FIG. 3 is a vertical section through the winch.
Figure 4:
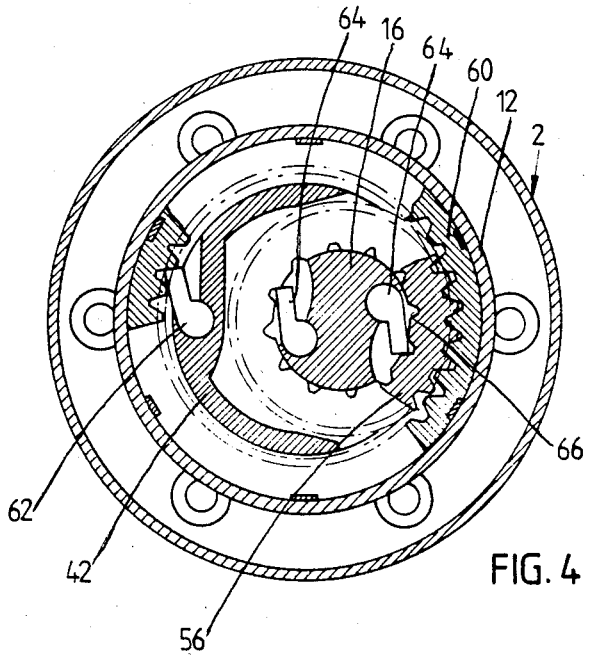
FIG. 4 is a horizontal section along the line IV—IV of FIG. 3.

As indicated in FIG. 2 and more clearly shown in FIGS. 3 and 4 the projecting pinion 56 is in driving engagement with a toothed rim 60, which is rigidly secured to the drum inside the inner lower cylindrical flange thereof. Hereby the desired driving engagement between the shaft 16 and the drum 2 is established in a simple manner. The drum will be rotated slightly slower than the shaft, but, in practice this is unimportant.

It should be mentioned that it is known to cause the drum to be rotated by a centrally arranged shaft having a pinion, which drives the drum through an intermediate pinion, but the intermediate pinion adds to the costs, and, moreover, the drum will inconveniently be rotated inversely of the handle.

It is desirable that the drum be self locking against rearward rotation, and as best shown in FIGS. 2 and 4 this is achieved by means of a spring loaded pawl 62 adjacent the thick side of the housing portion 42 cooperating with the said toothed rim 60.

It is also desirable that the crank handle be rearwardly rotatable by ratchet action, and, as shown in FIGS. 3 and 4, this is obtained by a couple of ratchet pawls 64 partly embedded in the lower end of the shaft 16 and cooperating with notches 66 in the inner hub surface of the pinion 56.

The shaft 16 and the pinion 56 are carried by a bottom plate 68, FIG. 4, which, like the pinion 56, is mounted by insertion through or into the open recess 58.

It is known that, with the use of a special gear mechanism, the drum may be driven in the same direction, but with a substantially changed speed of rotation, in response to the handle being rotated the other way. Here it is just to be mentioned that such a system may well be combined with the invention, e.g. with the gear mechanism arranged in connection with a downward prolongation of the shaft 16, which is already freely rotatable in the reverse direction.

The drum 2 itself is preferably made of stainless plate material, viz. by weld joining of an intermediate pipe length 68 (FIG. 3) as preshaped with widened end portions and a drawn up upper flange portion 70 having an upwardly extending neck portion a.o. for cooperation with the ball ring bearing 48, and, respectively, a lower ring member 72 as drawn up with a cross sectional shape as an inverted U for also forming the inner cylindrical flange 12.

The uppermost disc 6 on the drum consists of a stainless washer 74, the inner portion of which is axially engaging an abutment on the neck portion of the flange 70, and of an uppermost dish plate 76, which is topwise locked to the upper end of the same neck portion by means of a locking ring 78. The plate 76 includes a resilient plastic and is provided as a dish spring, which forces the washer 74 downwardly against the said abutment. However, just because of the dish spring 76, the washer 74 may be forced upwardly from the position shown, such that the groove 8 may work even with a rope of increased thickness. Optionally particular adjustment screws (not shown) may be provided for establishing a desired, fixed height position of the washer 74 for the handling of a rope of any given thickness. Besides, the washer 74 is non-rotatably connected with the neck portion of the disc 70 by means of a non-illustrated pin engagement with an axially extending holding groove.

I claim:

1. A capstan winch comprising a stationary base for mounting on a mounting surface so as to project therefrom, a stationary shaft element, a winch drum mounted on the shaft element, an outer drive member cooperating with a rotatable shaft in a middle area of the winch, said rotatable shaft being disposed eccentrically relative to the winch drum and being provided with monolaterally active driving means engaging an interior area of the drum for rotating the drum, said stationary shaft element projecting axially between the drum and the rotatable shaft at a location diametrically opposite to the engagement area of said driving means and further out to the free end of the drum, where the shaft element carries a fixed radial arm projecting outwardly and downwardly about an upper disc flange on the drum into an annular rope holding groove adjacent the upper end of the drum, characterized in that the driving means between the drum and the eccentric shaft includes a pinion mounted concentrically on the rotatable shaft and engages a partial area of an interior, relatively wider toothed rim on the drum.

2. A winch according to claim 1, in which the pinion and the toothed rim are mounted inside a widened end portion of the drum.

3. A winch according to claim 1, in which the same toothed rim cooperates with a ratchet pawl on the stationary shaft element.

4. A winch according to claim 1, in which the pinion is mounted in a recess in the shaft element, the pinion projecting from said recess.

5. A winch according to claim 1, in which the rotatable shaft is in driving engagement with the pinion through a one way coupling, from which the rotatable shaft is axially recessed.

* * * * *